US007472714B2

(12) United States Patent
Elick et al.

(10) Patent No.: US 7,472,714 B2
(45) Date of Patent: Jan. 6, 2009

(54) DISHWASHER DRAIN PUMP ASSEMBLY

(75) Inventors: Robert A. Elick, Jackson, TN (US); Mark E. Palm, Orlando, FL (US); Rodney M. Welch, Jackson, TN (US)

(73) Assignee: Maytag Corporation, Benton Harbor, MI (US)

( * ) Notice: Subject to any disclaimer, the term of this patent is extended or adjusted under 35 U.S.C. 154(b) by 659 days.

(21) Appl. No.: 11/052,928

(22) Filed: Feb. 9, 2005

(65) Prior Publication Data

US 2006/0174925 A1 Aug. 10, 2006

(51) Int. Cl.
*B08B 3/00* (2006.01)

(52) U.S. Cl. ..... 134/115 G; 134/104.4

(58) Field of Classification Search ..... None
See application file for complete search history.

(56) References Cited

U.S. PATENT DOCUMENTS

| | | | | |
|---|---|---|---|---|
| 3,434,671 | A | 3/1969 | Cushing et al. | |
| 3,963,046 | A * | 6/1976 | Bergeson | 137/565.17 |
| 3,981,456 | A | 9/1976 | Hahn et al. | |
| 4,201,345 | A | 5/1980 | Ziegler | |
| 4,276,005 | A * | 6/1981 | Bassan | 418/13 |
| 4,283,167 | A * | 8/1981 | Bassan et al. | 418/13 |
| 4,350,306 | A | 9/1982 | Dingler et al. | |
| 4,612,947 | A | 9/1986 | Duncan | |
| 4,795,102 | A | 1/1989 | Jordan et al. | |
| 5,450,868 | A | 9/1995 | Young, Jr. | |
| 5,628,334 | A | 5/1997 | Edwards et al. | |
| 5,725,002 | A * | 3/1998 | Payzant | 134/95.3 |
| 5,770,058 | A | 6/1998 | Jozwiak | |
| 5,779,812 | A * | 7/1998 | Thies et al. | 134/10 |
| 5,837,151 | A | 11/1998 | Jozwiak | |
| 6,103,017 | A | 8/2000 | Thies et al. | |
| 6,234,184 | B1 | 5/2001 | Tuller et al. | |
| 6,454,872 | B1 | 9/2002 | Miller et al. | |
| 6,471,467 | B1 | 10/2002 | Pagalday | |
| 2002/0125354 | A1 | 9/2002 | Jeffress | |
| 2004/0003833 | A1 * | 1/2004 | Elick et al. | 134/111 |

* cited by examiner

*Primary Examiner*—Mikhail Kornakov
*Assistant Examiner*—Eric Golightly
(74) *Attorney, Agent, or Firm*—John Morrison; Michael D. Lafrenz

(57) ABSTRACT

A dishwasher includes a drain pump assembly having a chopper assembly coupled to an impeller and driven by a synchronous motor. The chopper assembly includes an impeller housing that includes a central hub portion for pivotally supporting a plurality of rotatable chopper blades. An apertured plate is secured to the impeller housing and maintained in a spaced relationship from the chopper blades. The chopper assembly is coupled to the impeller through an axially sliding drive mechanism that facilitates assembly of the chopper assembly into the impeller housing. The synchronous motor drives the chopper blade in a first direction until encountering a hard soil particle whereupon the chopper blades can pivot so that the chopper assembly can continue to operate or, if the chopper blade becomes jammed, the synchronous motor can oscillate to hammer the hard soil particle until it becomes small enough to pass through the apertured plate.

20 Claims, 6 Drawing Sheets

DISHWASHER DRAIN PUMP ASSEMBLY

BACKGROUND OF THE INVENTION

1. Field of the Invention

The present invention pertains to the art of dishwashers and, more particularly, to a drain pump assembly employed in a dishwasher, preferably a drawer-type dishwasher.

2. Discussion of the Prior Art

In a typical dishwasher, washing fluid is pumped from a sump into upper and lower wash arms such that kitchenware, retained on vertically spaced racks within a tub of the dishwasher, will be sprayed with the washing fluid for cleaning purposes. The washing fluid is heated, filtered and recirculated through operation of a wash pump. Prior to recirculating the washing fluid, some or all of the fluid is directed through one or more filters to remove soil from the fluid, with the soil being collected in one or more chambers. Periodically, the system will be purged in order to drain the collection chamber (s) of the soil, as well as the washing fluid from the overall dishwasher.

In many dishwashers, the wash pump is provided with a chopper blade that is rotated about an apertured chopper plate to macerate soil particles entrained in the washing fluid. The wash pump can either be designed to macerate the food particles prior to recirculation or, upon draining the washing fluid from the washing chamber, macerate the soil particles during a drain operation. Regardless of the particular configuration, it has been found that incorporating the chopper blade into the wash pump increases noise output by the dishwasher. As the demand for quiet appliances is on the rise, this configuration requires re-design.

One proposed solution is to add a second or drain pump to the dishwasher. The drain pump can be fitted with the chopper blade so that soil particles are macerated only during operation of the drain pump. Due to the fact that the drain pump is operated less frequently than the wash pump, the overall noise produced by the dishwasher can be reduced. However, in addition to noise considerations, size, and particularly vertical height, is also a consideration when designing a dishwasher. Thus, adding a second pump to the dishwasher presents a different set of design considerations. Fortunately, in contrast to recirculating fluid within the dishwasher where high pressure is required, drain pumps do not have a corresponding high pressure requirement. Instead, a drain pump need only overcome a pressure head maintained in a siphon loop of a drain hose. Therefore, a relatively small pump can be used to drain washing fluid and soil from the dishwasher.

While smaller pumps can generate sufficient pressure to perform a drain operation, the smaller pumps typically employ a synchronous motor and produce less torque. That is, when operating a chopper mechanism, the smaller pump cannot rotate a chopper blade with as much torque as a larger pump. If the chopper blade encounters a hard or large soil particle, the pump could stall or jam. When a stall condition occurs, the synchronous motor must restart, causing the chopper blade to repeatedly impact the large/hard soil particle. That is, when the synchronous motor restarts, the chopper blade oscillates back and forth "hammering" the soil particle until the particle becomes small enough to pass through the apertured plate. While effective, it may take some time to fully break up the soil particle as the smaller pump cannot impart a high degree of inertia to rotate the chopper blade. Also, while the synchronous motor is stalled, draining is postponed until the particle can pass through the apertured plate. Obviously, this interaction can create a substantial amount of noise, as well as lengthen an overall wash operation.

Another consideration when constructing a drain pump is the overall construction and assembly of the pump. Minimizing potential leakage points is critical. Therefore, the drain pump should be constructed so as to reduce the number of openings or joints that could act as potential leakage points. Ideally, the drain pump would be formed from a one piece housing into which all the components are installed. However, when positioning components in a one piece housing, it can be difficult to locate the chopper blade relative to the chopper plate and to connect the pump with a pump motor. Too large a gap between the chopper blade and the chopper plate will allow soil particles to become trapped or stuck in openings that are arrayed about the apertured plate. Too small a gap and the chopper blade can become jammed or could come in contact with and abrade the chopper plate, resulting in damage to either one or both components.

Based on the above, there still exists a need for an enhanced drain pump for a dishwasher, preferably a low profile drain pump that operates a chopper blade to macerate soil particles in a washing fluid. In addition, there exists a need for a drain pump that includes an alignment device that assures proper positioning of the chopper blade relative to an apertured chopper plate.

SUMMARY OF THE INVENTION

The present invention is directed to a dishwasher including a tub having integral top, bottom, rear and opposing side walls that collectively define a washing chamber. The dishwasher also includes a wash pump for delivering a washing fluid to at least one wash arm in the washing chamber and a drain pump for expelling at least a portion of the washing fluid during purging and/or draining operations. The drain pump includes a pump housing having both an inlet portion and an outlet portion. An impeller, having a central recess portion and a plurality of vanes, is rotatably driven by a synchronous motor secured to the pump housing. More specifically, the plurality of vanes extend radially outward from the central recess portion so that, upon rotation of the impeller, a flow of washing fluid is established. In addition, the drain pump includes a chopper assembly including at least one blade member and an apertured plate mounted between the intake portion of the housing and the impeller. During a drain or purge operation, the chopper assembly macerates soil particles entrained in the washing fluid.

In accordance with a preferred embodiment of the present invention, the drain pump includes a central hub positioned at the inlet portion of the pump housing. The central hub includes a bearing surface that is adapted to support, at least partially, the chopper assembly. More specifically, the chopper assembly is drivingly connected to the impeller through an axially sliding drive mechanism. The drive mechanism includes a first end mounted within the central recess of the impeller that extends through the central hub to a second end that is connected to the chopper assembly. With this arrangement, a proper alignment or spacing can be achieved between the blade member and the apertured plate.

In further accordance with the preferred embodiment of the present invention, the at least one blade member is pivotal about an axis extending substantially perpendicular to the apertured plate. With this arrangement, in the event the blade member contacts a large or hard soil particle, the blade member will pivot or deflect around the soil particle so that the motor does not stall. However, continued rotation of the chopper blade will eventually reduce the soil particle to a size small enough to pass through openings in the apertured plate. However, in the event the large particle does cause the motor to stall, the motor is oscillated so that the blade member repeatedly impacts, or hammers, the soil particle from two directions.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
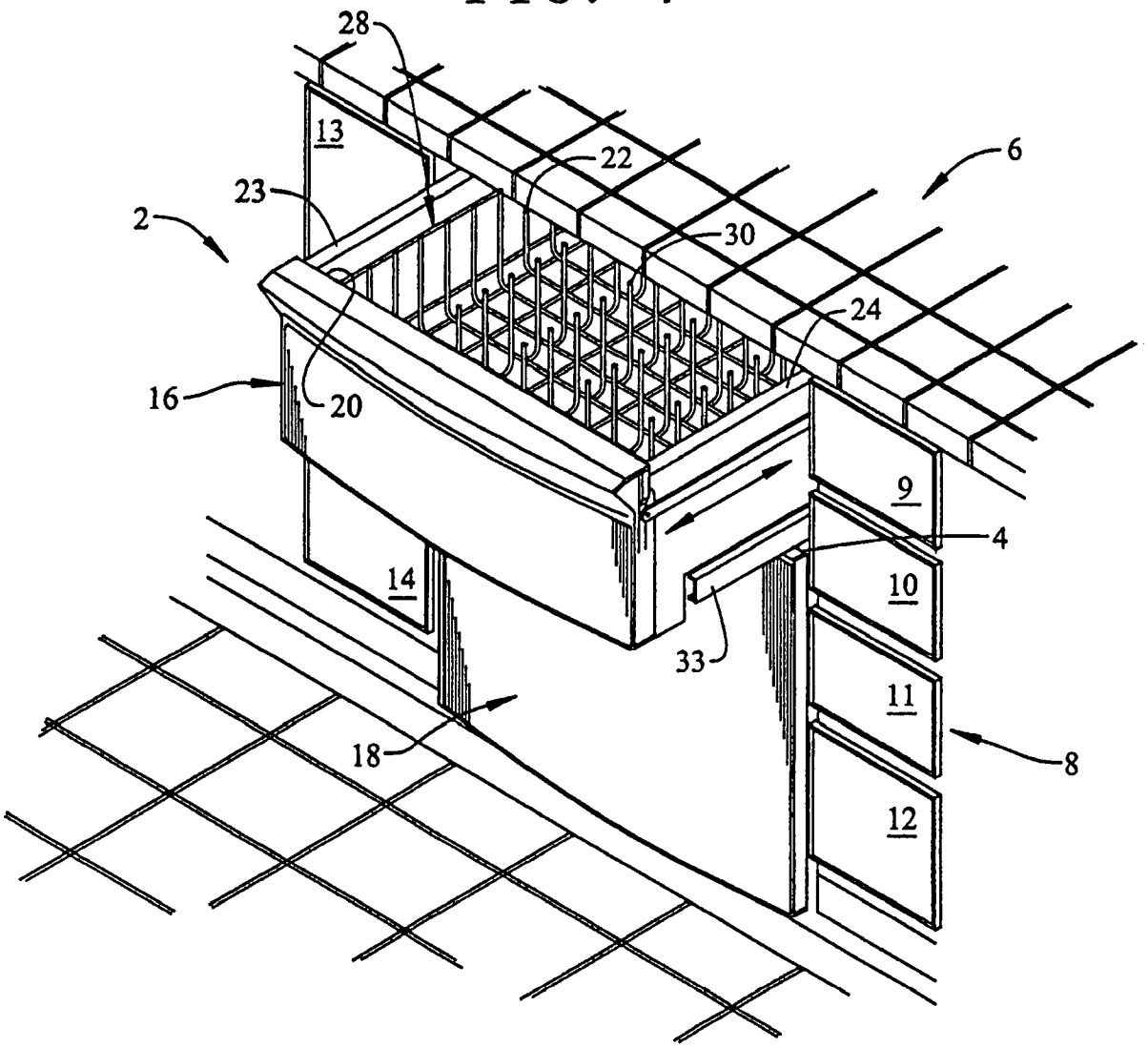
FIG. 1 is an upper right perspective view of a drawer-type dishwasher having a drain pump assembly constructed in accordance with the present invention.
Figure 2:
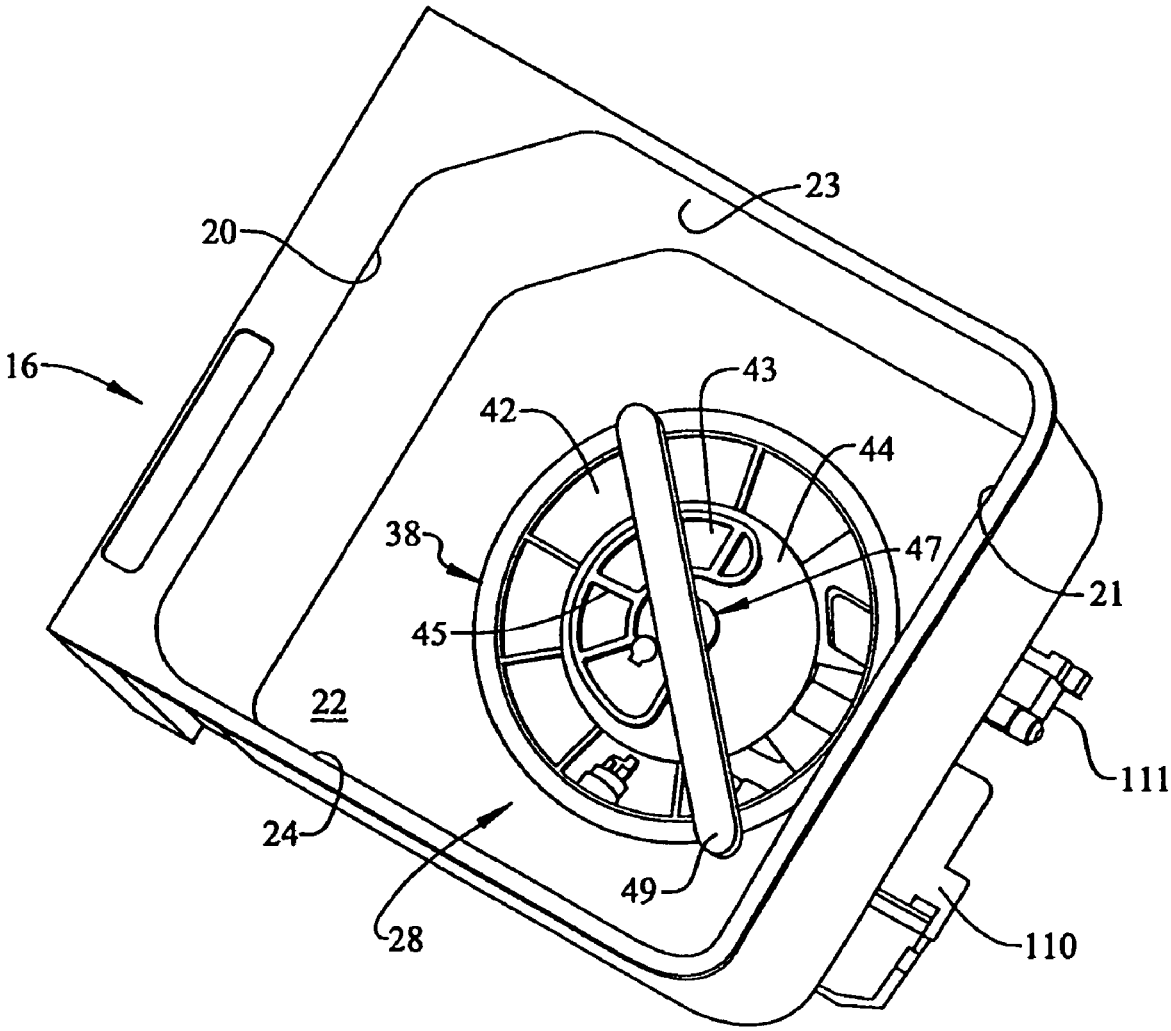
FIG. 2 is an upper perspective view of a wash tub of the dishwasher of FIG. 1.

With initial reference to FIGS. 1 and 2, a dishwasher constructed in accordance with the present invention is generally indicated at 2. As shown, dishwasher 2 includes a support frame 4 arranged below a kitchen countertop 6. Also below kitchen countertop 6 is shown cabinetry 8 including a plurality of drawers 9-12, as well as cabinet doors 13 and 14. Although the actual dishwasher into which the present invention may be incorporated can vary, the invention is shown in connection with dishwasher 2 depicted as a dual cavity dishwasher having an upper washing unit 16 and a lower washing unit 18. As best illustrated in FIG. 1, upper washing unit 16 takes the form of a slide-out drawer unit having a small or medium capacity so as to be used for cleaning glassware and the like, while lower cavity 18 is illustrated as a larger capacity drawer for washing items such as dinnerware, cookware and other large sized objects.

In accordance the invention, upper washing unit or drawer 16 is shown to include a front wall 20, a rear wall 21, a bottom wall 22 and opposing side walls 23 and 24 that collectively define an upper washing chamber or tub 28. In a manner known in the art, upper washing tub 28 is provided with a dish rack 30 for supporting various objects, such as glassware, and the like, to be exposed to a washing operation. In a manner also known in the art, upper washing unit 16 is slidingly supported within support frame 4 through a pair of extensible drawer support guides, one of which is indicated at 33.

As best shown in FIG. 2, a main filter housing 38 is provided along bottom wall 22 within washing tub 28. Main filter housing 38 is actually positioned within a central, generally U-shaped, intake ring 40 (see FIG. 3) formed in bottom wall 22. In any event, main filter housing 38 includes a coarse or first radial strainer 42, a fine or second radial strainer 43 and a cover 44. Actually, second radial strainer 43 is part of a fine particle filter chamber (not shown) including a fine mesh filter screen (not separately illustrated) provided within each of a plurality of large radial spaced openings 45 arranged about cover 44. A hub member 47 extends through cover 44 and serves as a support for a wash arm 49. As will be discussed more fully below, wash arm 49 directs a flow of washing fluid onto kitchenware placed within washing tub 28 on rack 30.

Figure 3:
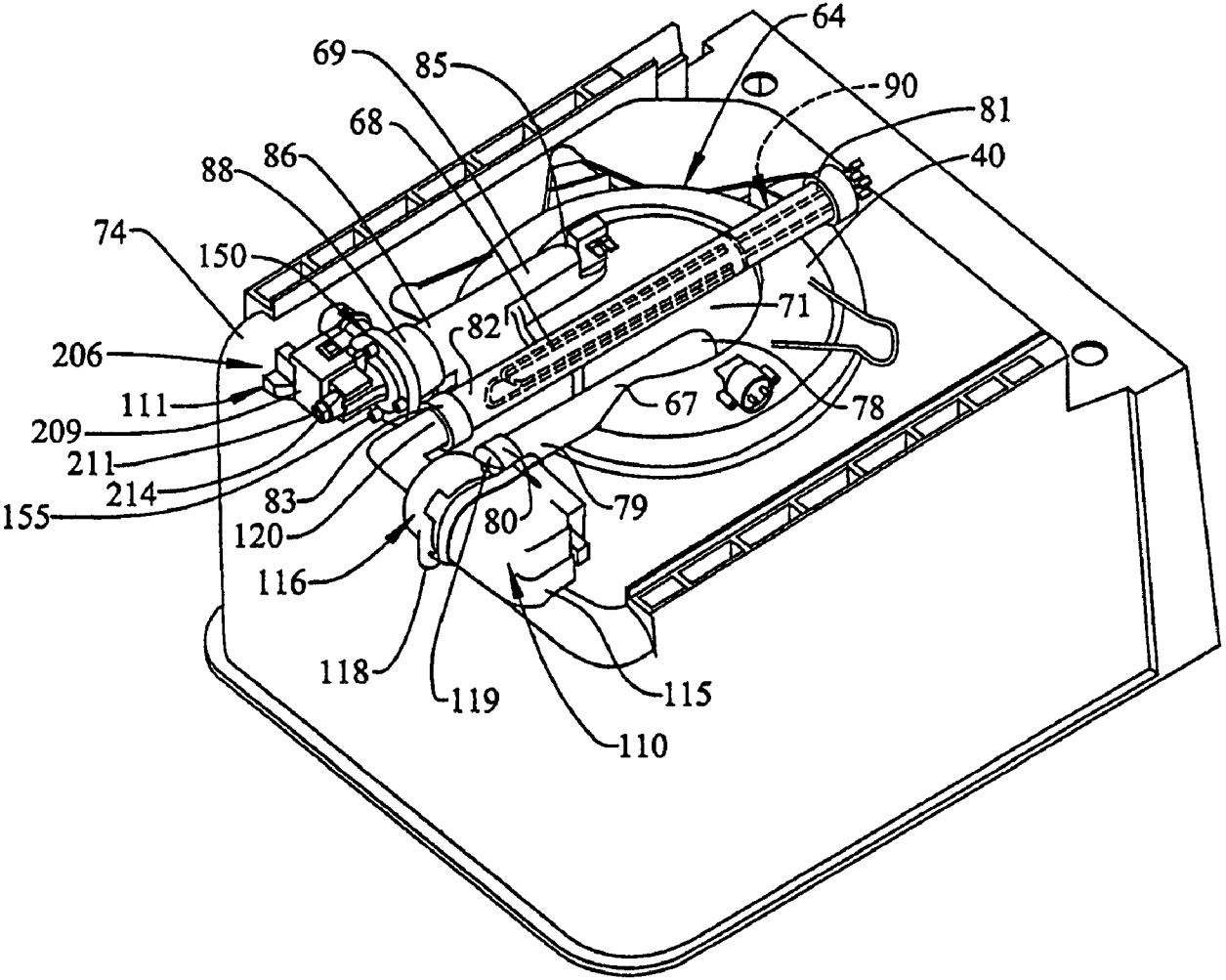
FIG. 3 is a lower perspective view of the tub of FIG. 2.

With particular reference to FIG. 3, washing tub 28 includes a sump 64 having a plurality of fluid conduits 67-69 formed along bottom wall 22 of washing tub 28. In accordance with one form of the invention, fluid conduit 67 constitutes a wash fluid supply conduit, fluid conduit 68 constitutes a wash fluid recirculation conduit, and fluid conduit 69 constitutes a wash fluid drain conduit so that each of fluid conduits 67-69 provide washing fluid flow management during various portions of a washing operation. Preferably, fluid conduits 67 and 69 are spaced from and arranged substantially parallel to one another across bottom wall 22, while extending from a central portion 71 of intake ring 40 to an outer edge portion 74 of washing tub 28. On the other hand, fluid conduit 68 extends across intake ring 40 between fluid conduits 67 and 69. More specifically, supply conduit 67 includes a first end 78 which is fluidly connected to wash arm 49 and leads to a second end 79. Second end 79 is provided with an attachment or mounting flange 80. Likewise, recirculation conduit 68 extends from a first portion 81, which is positioned at a front edge of intake ring 40, to a second end 82. Recirculation conduit 68 is provided with an inlet (not shown) that receives a flow of washing fluid from wash tub 28. In a manner similar to that described with respect to supply conduit 67, recirculation conduit 68 is provided with a corresponding attachment or mounting flange 83. Finally, drain conduit 69 extends from a first end 85, which is in fluid communication with main filter housing 38, to a second end 86, which is also provided with an attachment or mounting flange 88.

In addition to managing the flow of washing fluid in dishwasher 2, sump 64 serves as a mounting platform for a plurality of wash system components. As best shown in FIG. 3, a wash pump 110 and a drain pump 111 are mounted to washing tub 28 along outer edge portion 74. More specifically, wash pump 110 and drain pump 111 are connected to mounting flanges 80, 83 and 88 respectively. Preferably, wash pump 110 includes a wash motor housing 115 and a wash pump housing 116. In the embodiment shown, wash pump housing 116 includes a fresh water inlet 118, a supply outlet 119 and a recirculation inlet 120. Supply outlet 119 directs washing fluid to wash arm 49, while recirculation inlet 120 conducts washing fluid back from washing tub 28 into wash pump housing 116. Toward that end, wash pump housing 116 is generally F-shaped, with supply outlet 119 and recirculation outlet 120 terminating in mounting flanges 80 and 83 respectively. With this overall construction, a substantially closed loop recirculation system is formed within washing tub 28. In accordance with one aspect of the invention, a heating element 90 is mounted within recirculation conduit 68. In accordance with the embodiment shown, washing fluid flowing from washing tub 28 through recirculation conduit 68 can be heated by selectively activating heating element 90. In any event, a more detailed description of sump 64 can be found in commonly assigned U.S. patent application Ser. No. entitled "Multi-Use Sump for a Drawer-Type Dishwasher" which is filed on even date herewith and incorporated herein by reference. The present invention is directed to the particular design, construction and operation of drain pump 111.

Figure 4:
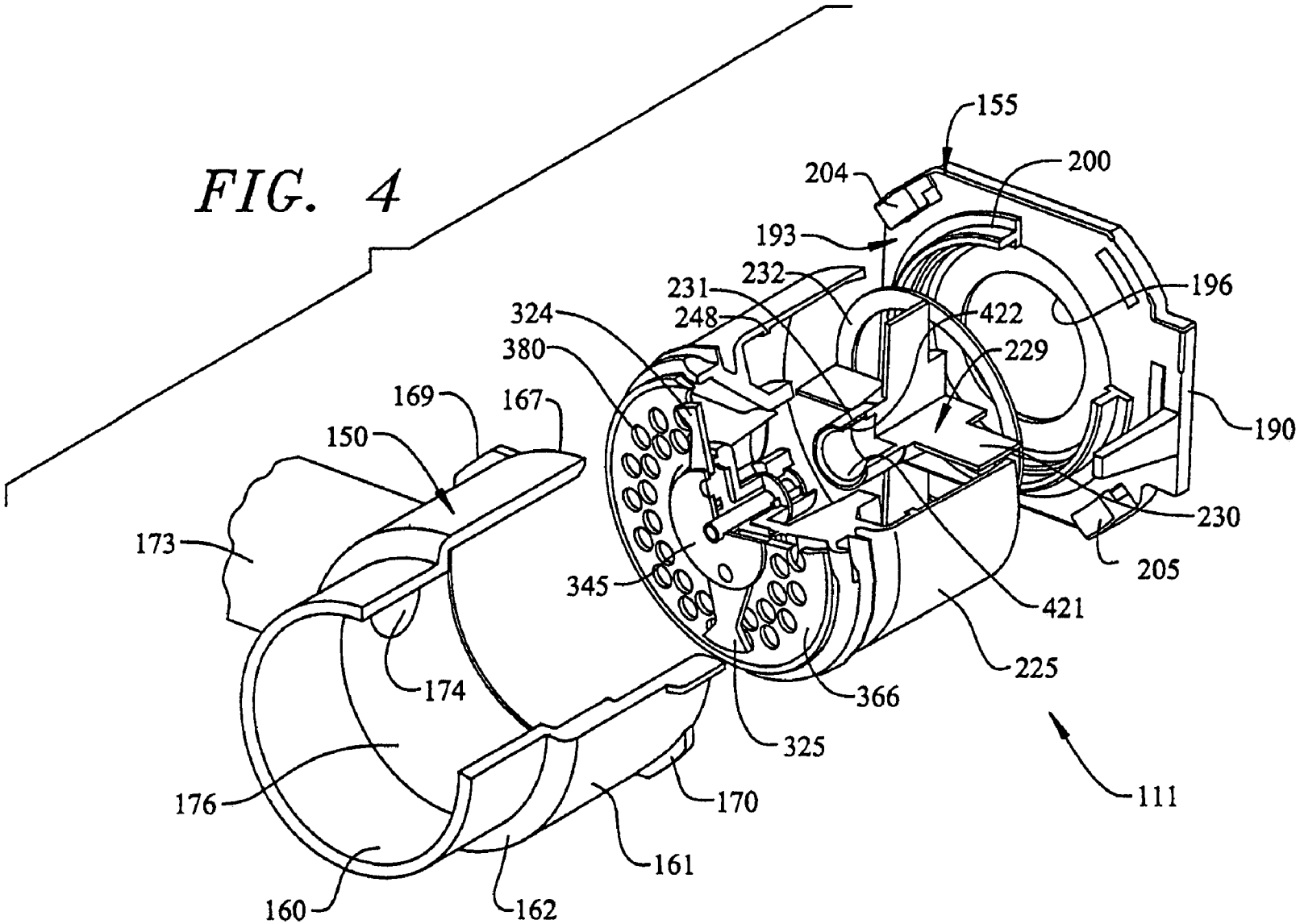
FIG. 4 is an exploded, partial cut-away view of a portion of a drain pump assembly constructed in accordance with the present invention.
Figure 5:
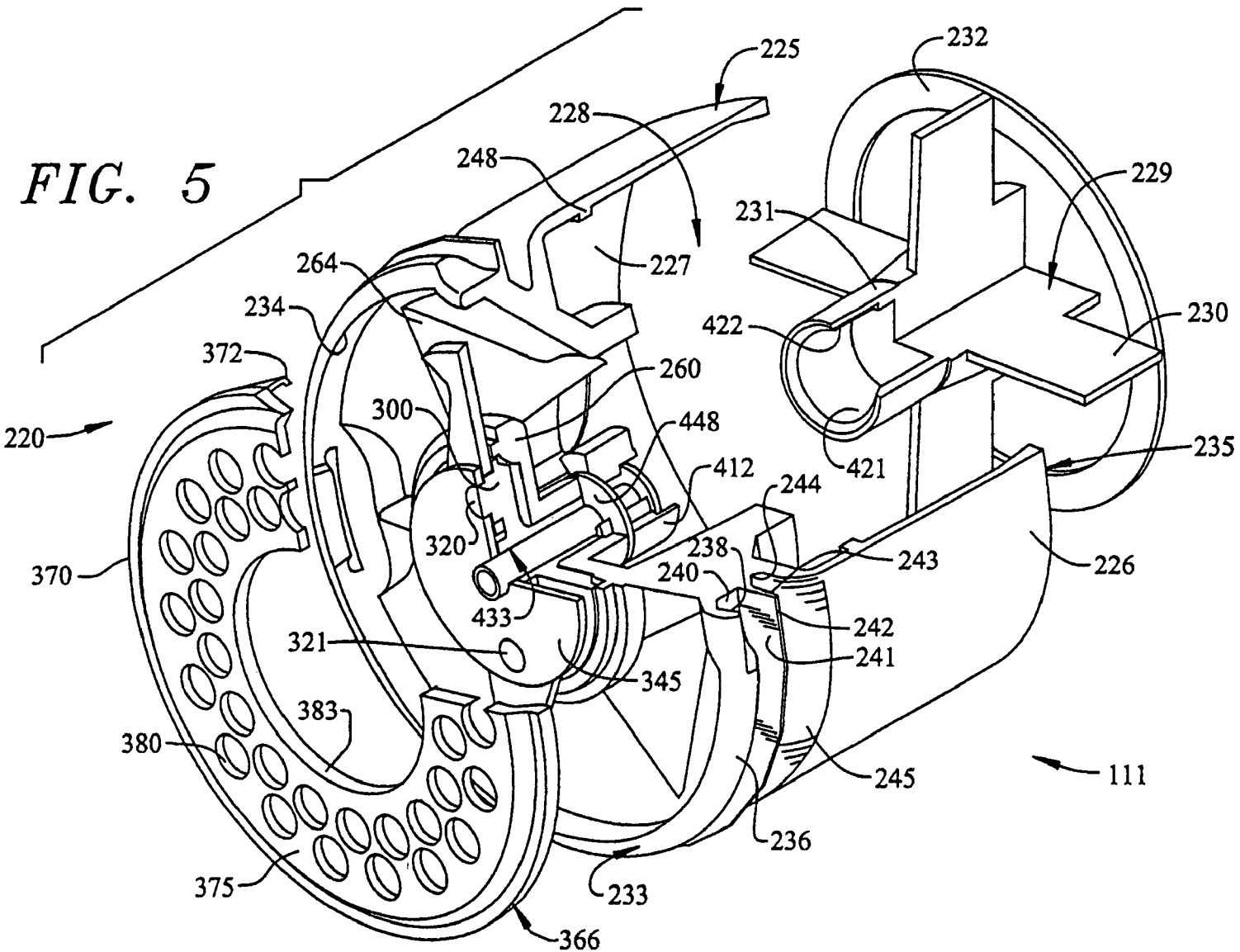
FIG. 5 is an enlarged, partial cut-away view of an impeller housing and chopper assembly of the drain pump assembly of FIG. 4.
Figure 6:
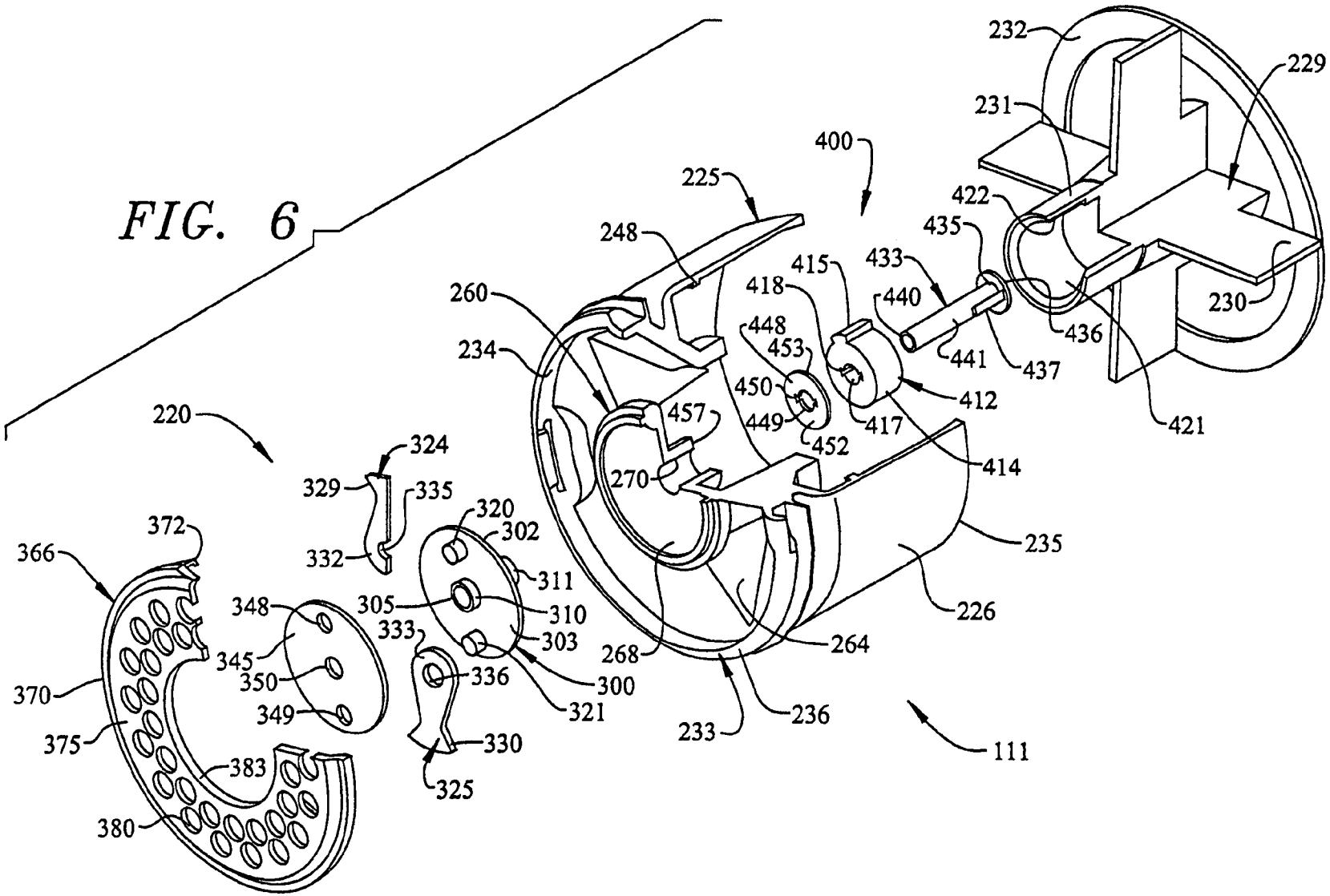
FIG. 6 is an exploded, partial cut-away view of the impeller housing and chopper assembly of FIG. 5.

As best seen in FIGS. 4-6, drain pump 111 includes a pump housing 150 and a motor base 155. In accordance with a preferred form of the invention, pump housing 150 includes an inlet portion 160 extending to an outlet portion 161 through a tapered segment 162. Inlet portion 160 is adapted to be inserted into mounting flange 88 of drain conduit 69. In the embodiment shown, outlet portion 161 extends from tapered segment 162 to a sealing edge portion 167 adapted to abut motor base 155. As will be detailed more fully below, sealing surface 167 is secured to motor base 155 through a pair of mounting ears 169 and 170. In addition, outlet portion 161 is provided with a discharge conduit 173 including an outlet passage 174 that, in the embodiment shown, extends generally perpendicularly from an interior region 176 of outlet portion 161 and leads to a drain through a drain hose (not shown).

In further accordance with the embodiment shown, motor base 155 includes an outer edge portion 190 that defines a sealing surface 193 adapted to abut with sealing edge portion 167 of pump housing 150. Sealing surface 193 is provided with a central opening 196 about which is arranged a locating ring 200. In order to secure motor base 155 to pump housing 150, a plurality of preferably L-shaped mounting lugs, two of which are indicated at 204 and 205, project generally perpendicularly from sealing surface 193. L-shaped mounting lugs 204 and 205 are formed so as to receive mounting ears 169 and 170 in a twist-lock fashion so as to removably secure motor base 155 to pump housing 150 while, at the same time, providing a snug fit to prevent washing fluid from escaping out of pump housing 150. Of course, pump housing 150 could be sealed to motor base 155 using a silicone gasket material or through sonic welding or other more permanent means so as to ensure a leak-tight fit. In the embodiment shown, motor base 155 is also adapted to support a motor assembly 206 (FIG. 3). That is, a synchronous motor 209 including a permanent magnet rotor 211 is secured to motor base 155 so as to drive drain pump 111. Furthermore, arranged about permanent magnet rotor 211 are a pair of motor coils, one of which is indicated at 214, that provide the impetus to rotate rotor 211.

As best illustrated in FIGS. 4-6, drain pump 111 also includes a chopper assembly 220 arranged within interior region 176 of pump housing 150. In accordance with the preferred embodiment shown, chopper assembly 220 includes an impeller housing 225 having an outer surface 226 and an inner surface 227 that collectively define an impeller chamber 228. Arranged within impeller chamber 228 is an impeller 229 having a plurality of vanes 230 that extend from a central hub 231. In accordance with one aspect of the invention, vanes 230 are interconnected by a flange 232 that bifurcates impeller 229. More specifically, flange 232 divides impeller 229 into an intake portion and a discharge portion (not separately labeled). Impeller 229 is drivenly connected to rotor 211 of motor assembly 206 through a drive shaft (not shown) that extends through central opening 196 in motor base 155. In any event, impeller housing 225 includes a first end 233 which defines an overall intake opening 234 and leads to a second end 235 adapted to receive and seat about locating ring 200 so as to position and support impeller housing 225 within pump housing 150.

In the embodiment shown, first end 233 includes a first lip portion 236 (FIG. 5) that extends inward to a first segment 238. First segment 238 leads to a second segment that defines a first land 240. First land 240 merges to a third segment 241 that leads to a second lip portion 242. As further shown in FIG. 5, second lip portion 242 extends through a fourth segment 243 to a second land, illustrated at 244, which ultimately leads to a tapered portion 245. Tapered portion 245 leads to outer surface 226 of intake housing 225 and ultimately terminates at second end 235. In addition, impeller housing 225 includes an annular rib 248 formed on inner surface 227. Rib 248 protrudes, as near as reasonably possible, toward vanes 230 to reduce circulation losses from a peripheral portion (not separately labeled) of intake opening 234.

First end 233 includes a hub portion 260 (FIG. 6) that is supported within intake opening 231 by a plurality of flow straightening fins, one of which is indicated at 264. Flow straightening fins 264 are provided to straighten a flow of washing fluid entering intake opening 234 and flowing into impeller chamber 228. The rotation of chopper assembly 220 imparts a rotation to the washing liquid entering intake opening 234. Without flow straightening fins 264, the washing fluid could cavitate, thereby causing an increase in noise output and a decrease in pump efficiency. In further accordance with the embodiment shown, hub portion 260 includes a bearing surface 268 having a central passage 270. Bearing surface 268 provides a gliding and support surface for chopper assembly 220 as will be discussed further below.

As best shown in FIG. 6, chopper assembly 220 includes a guide bearing 300 having an inner surface 302 adapted to rotate against bearing surface 268 of hub portion 260, an outer surface 303 and a central hub 305. Central hub 305 preferably includes a first portion 310 that extends perpendicularly beyond outer surface 303, and a second portion 311 that extends beyond inner surface 302 and is adapted to extend within central passage 270 of hub 260. Outer surface 303 is also provided with a pair of opposing spindles 320 and 321. In accordance with the most preferred form of the invention, spindles 320 and 321 pivotally support respective blade members 324 and 325. Each blade member 324 and 325 includes a respective cutting end portion 329 and 330, as well as a pivoting portion 332 and 333 having a respective opening 335 and 336. Openings 335 and 336 are sized so as to be positioned over spindles 320 and 321 so that blades 324 and 325 can pivot relative to guide bushing 300. Chopper assembly 220 further includes a mounting plate 345 adapted to retain blade members 324 and 325. Toward that end, mounting plate 345 includes a pair of opposing outer openings 348 and 349 sized to slide over and engage spindles 320 and 321, and a central opening 350 adapted to engage over central hub 305 of guide bearing 300. Thereafter, mounting plate 345 is fixed in place relative to guide bushing 300, such as by welding or other means known in the art.

During draining and/or purging portions of a washing operation, blade members 324 and 325 are rotated about an apertured plate 366 to macerate food particles that are contained within the washing fluid. Apertured plate 366 includes an outer edge portion 370 having an L-shaped lip 372 adapted to snap-fittingly engage onto first lip portion 236 of impeller housing 225. Outer edge portion 370 leads to a cutting plate portion 375 having a plurality of openings or apertures, one of which is indicated at 380, and a central opening 383. With this arrangement, chopper assembly 220 can be assembled and mounted within hub 260 before apertured plate 366 is mounted to impeller housing 225. In accordance with the most preferred form of the invention, once chopper assembly 220 is arranged within hub 260, blade members 324 and 325 can be deflected about spindles 320 and 321 so as to pass through central opening 383 of apertured plate 366. In this manner, a preferred spacing can be maintained between each blade members 324,325 and apertured plate 366 so as to adequately chop or macerate food particles without having food particles become trapped between blade members 324 and 325 and apertured plate 366.

Given that blade members 324 and 325 pivot about spindles 320 and 321, in the event that a large or hard food particle becomes lodged against apertured plate 366, blade members 324 and 325, upon impacting the hard food particle, can pivot or deflect, thus enabling chopper assembly 220 to continue rotating without becoming jammed. Actually, with this particular arrangement, blade members 324 and 325 will hammer against a food particle that is too large to pass through apertures 350 until, eventually, the food particle crumbles and passes through one of openings 380 in apertured plate 366.

In further accordance with the most preferred form of the invention, in the event that chopper assembly 220 does become jammed, synchronous motor 209 can be oscillated or operated in reverse a short distance, e.g., through 90° of rotation, so as to allow blade members 324 and 325 to become dislodged and then rotated in a forward direction to macerate the food particle. The fact that blade members 324 and 325 pivot also provides another advantage. As most drain motors have a low torque rating, allowing blade members 324 and 325 to pivot enables motor 209 to achieve a desired speed without having to initially overcome the inertia of blade members 324 and 325. Pivoting blade members 324 and 325 therefore require less initial inertia when rotated. As motor 209 reaches the desired speed, blade members 324 and 325 become fully extended and rotate about cutting plate portion 375.

In order to further ensure a proper spacing between blade members 324 and 325 during assembly of pump housing 150, chopper assembly 220 is drivenly connected to impeller 229 through an axially sliding drive mechanism 400. In still further accordance with the most preferred form of the invention, axially sliding drive mechanism 400 includes an impeller guide bushing 412 having an outer surface 414 provided with a key element 415. Guide bushing 412 is also provided with an inner bore 417 having an inner keyway 418. Guide bushing 412 is adapted to seat or nest within a central recess portion 421 of impeller 229 that includes a corresponding keyway 422 so as to receive key element 415. Extending through guide bushing 412 and interconnecting with guide bearing 300 is a drive pin 433. In the embodiment shown, drive pin 433 includes a first end 435 having a cap member 436 adapted to nest within central recess portion 421 of impeller 229, a key element 437 adapted to extend into inner keyway 418 of guide bushing 412, a second end portion 440 and an intermediate portion 441. Second end 440 is adapted to extend through hub 305 of guide bearing 300 and either be secured through an interference type fit or through use of a rivet, pin or other mechanical attachment. In order to minimize friction between guide bushing 412 and hub member 268 of impeller housing 225, a bearing or washer 448 is provided therebetween. As shown, bearing 448 includes a central opening 449 having a keyway 450 adapted to receive key element 437 of drive pin 433 and a pair of opposing bearing surfaces 452 and 453. Bearing surface 452 is adapted to ride against a rear bearing surface 457 of hub 260 in order to prevent wear and extend the overall operation and life of chopper assembly 220.

With the above description, it should be readily apparent that drain pump 111 can be assembled with minimal potential leakage points while, at the same time, enabling ease of assembly, providing toleranced clearance for cutting blade members to rotate about an apertured plate, and preventing the chopper from becoming jammed so as to provide a smaller dishwasher, preferably a drawer-type dishwasher, with many of the advantageous features found in larger dishwasher models. Although described with reference to a preferred embodiment of the present invention, it should be readily apparent to one of ordinary skill in the art that various changes and/or modifications can be made to the invention without departing from the spirit thereof. For instance, the particular shape and number of blade members 324 and 325 could vary without departing from the spirit of the present invention. In addition, while the axially sliding drive mechanism is described as being keyed to the impeller, splines are also acceptable. In general, the invention is only intended to be limited by the scope of the following claims.

We claim:

1. A dishwasher comprising:

a tub including at least bottom, rear and opposing side walls that collectively define a washing chamber;

a dish rack mounted within the washing chamber, said dish rack being adapted to support dishware during a washing operation;

a wash pump for delivering a washing fluid to at least one wash arm in the washing chamber during select portions of the washing operation; and a drain pump for expelling at least a portion of the washing fluid during select portions of the washing operation, said drain pump including:

a pump housing having an inlet portion and an outlet portion;

an impeller including a central hub and a plurality of vanes, said plurality of vanes extending radially outward from the central hub;

an apertured plate positioned at the inlet portion of the pump housing;

a chopper assembly having a pivoting blade member positioned adjacent the apertured plate; and an axially sliding drive mechanism having a first end mounted within the central hub of the impeller and extending through the apertured plate to a second end which is drivingly connected to the blade member of the chopper assembly wherein the axially driving drive mechanism includes a guide bushing including at least one of an axially projecting key member and a keyway, and the axially sliding drive mechanism enables the blade member to shift axially relative to the apertured plate during operation of the dishwasher drain pump.

2. The dishwasher according to claim 1, wherein the drain pump includes a plurality of fins radially interposed between the central hub and the pump housing, said plurality of fins functioning to reduce a rotational force applied to the washing fluid by operation of the drain pump.

3. The dishwasher according to claim 1, further comprising:

an impeller housing within which the impeller is rotatably supported; and a bearing positioned in the impeller housing and rotatably supporting the axially sliding drive mechanism.

4. The dishwasher according to claim 3, wherein the impeller housing includes an inner surface having formed thereon an annular rib, said annular rib protruding toward the plurality of vanes on the impeller.

5. The dishwasher according to claim 1, wherein the guide bushing includes an external surface provided with at least one axially projecting key member and a central bore provided with at least one keyway.

6. The dishwasher according to claim 5, wherein the central hub of the impeller drivingly engages the at least one axially projecting key member.

7. The dishwasher according to claim 5, wherein the axially sliding drive mechanism includes a drive pin extending through the central bore and being drivingly connected to each of the guide bushing and the chopper assembly, said drive pin including at least one axially projecting key member that engages with the at least one keyway such that the pivoting blade member is drivingly interconnected with the impeller.

8. The dishwasher according to claim 7, wherein the drive pin includes a cap member seated within the guide bushing.

9. The dishwasher according to claim 1, wherein the chopper assembly includes a guide bearing provided with at least one spindle and a mounting plate, said pivoting blade member being mounted on the spindle for rotation relative to the guide bearing and sandwiched between the guide bearing and the mounting plate.

10. The dishwasher according to claim 1, wherein the impeller includes a flange interconnecting the plurality of vanes, said flange bifurcating the impeller into an inlet portion and a discharge portion.

11. A dishwasher drain pump comprising:

a pump housing having an inlet portion and an outlet portion;

an impeller including a central hub and a plurality of vanes, said vanes extending radially outward from the central hub;

an apertured plate positioned at the inlet portion of the pump housing;

a chopper assembly having a pivoting blade member positioned adjacent the apertured plate; and an axially sliding drive mechanism having a first end mounted within the central hub of the impeller and extending through apertured plate to a second end which is drivingly connected to the blade member of the chopper assembly, wherein the axially sliding drive mechanism includes a guide bushing including at least one of an axially projecting key member and a keyway, and the axially sliding drive mechanism enables the blade member to shift axially relative to the apertured plate during operation of the dishwasher drain pump.

12. The dishwasher drain pump according to claim 11, further comprising: a plurality of fins radially interposed between the central hub and the pump housing, said plurality of fins functioning to reduce a rotational force applied to the washing fluid by operation of the drain pump.

13. The dishwasher drain pump according to claim 11, further comprising:

an impeller housing within which the impeller is rotatably supported; and a bearing positioned in the impeller housing and rotatably supporting the axially sliding drive mechanism.

14. The dishwasher drain pump according to claim 13, wherein the impeller housing includes an inner surface having formed thereon an annular rib, said annular rib protruding toward the plurality of vanes on the impeller.

15. The dishwasher drain pump according to claim 11, wherein the guide bushing includes an external surface provided with at least one axially projecting key member and a central bore provided with at least one keyway.

16. The dishwasher drain pump according to claim 15, wherein the central hub of the impeller drivingly engages the at least one axially projecting key member.

17. The dishwasher drain pump according to claim 15, wherein the axially sliding drive mechanism includes a drive pin extending through the central bore and being drivingly connected to each of the guide bushing and the chopper assembly, said drive pin including at least one axially projecting key member that engages with the at least one keyway such that the pivoting blade member is drivingly interconnected with the impeller.

18. The dishwasher drain pump according to claim 17, wherein the drive pin includes a cap member seated within the guide bushing.

19. The dishwasher according to claim 17, wherein the chopper assembly includes a guide bearing provided with at least one spindle and a mounting plate, said pivoting blade member being mounted on the spindle for rotation relative to the guide bearing and sandwiched between the guide bearing and the mounting plate.

20. The dishwasher drain pump according to claim 11, wherein the impeller includes a flange interconnecting the plurality of vanes, said flange bifurcating the impeller into an inlet portion and a discharge portion.

* * * * *